US012338579B2

(12) United States Patent
Strengell et al.

(10) Patent No.: US 12,338,579 B2
(45) Date of Patent: Jun. 24, 2025

(54) COMPOSITION AND METHOD FOR MANUFACTURE OF PAPER, BOARD OR THE LIKE

(71) Applicant: Kemira Oyj, Helsinki (FI)

(72) Inventors: Kimmo Strengell, Helsinki (FI); Asko Karppi, Espoo (FI)

(73) Assignee: Kemira Oyj, Helsinki (FI)

( * ) Notice: Subject to any disclaimer, the term of this patent is extended or adjusted under 35 U.S.C. 154(b) by 218 days.

(21) Appl. No.: 17/905,406

(22) PCT Filed: Mar. 4, 2021

(86) PCT No.: PCT/FI2021/050156

§ 371 (c)(1),
(2) Date: Aug. 31, 2022

(87) PCT Pub. No.: WO2021/176143

PCT Pub. Date: Sep. 10, 2021

(65) Prior Publication Data

US 2023/0122111 A1 Apr. 20, 2023

(30) Foreign Application Priority Data

Mar. 6, 2020 (FI) ..... 20205241

(51) Int. Cl.

| | |
|---|---|
| ***D21H 17/55*** | (2006.01) |
| ***D21H 17/37*** | (2006.01) |
| ***D21H 17/42*** | (2006.01) |
| ***D21H 17/44*** | (2006.01) |
| ***D21H 21/20*** | (2006.01) |
| ***D21H 23/04*** | (2006.01) |

(52) U.S. Cl.
CPC ..... *D21H 17/55* (2013.01); *D21H 17/375* (2013.01); *D21H 17/42* (2013.01); *D21H 17/44* (2013.01); *D21H 21/20* (2013.01); *D21H 23/04* (2013.01)

(58) Field of Classification Search
CPC ..... D21H 17/55; D21H 17/375; D21H 17/42; D21H 17/44; D21H 21/20; D21H 23/04; D21H 17/41
See application file for complete search history.

(56) References Cited

U.S. PATENT DOCUMENTS

| | | | | |
|---|---|---|---|---|
| 10,689,809 | B2 | 6/2020 | Faucher et al. | |
| 2008/0050602 | A1 | 2/2008 | Spraul et al. | |
| 2012/0118523 | A1 | 5/2012 | Lu et al. | |
| 2016/0222590 | A1* | 8/2016 | Zhu | D21H 17/37 |
| 2018/0320316 | A1 | 11/2018 | Zhao et al. | |
| 2019/0048530 | A1 | 2/2019 | Faucher et al. | |

FOREIGN PATENT DOCUMENTS

| | | | | |
|---|---|---|---|---|
| CN | 109563686 | | 9/2017 | |
| CN | 107849815 | | 3/2018 | |
| EP | 3250752 | A1 | 12/2017 | |
| WO | 9806898 | A1 | 2/1998 | |
| WO | 2015038901 | A1 | 3/2015 | |
| WO | 2018055239 | A1 | 3/2018 | |
| WO | WO-2020012074 | A1 * | 1/2020 | D21H 11/04 |
| WO | 2020045514 | A1 | 3/2020 | |

OTHER PUBLICATIONS

Fisher Stephen A Nov. 1996 : Structure and wet strength activity of polyamidoamine epichlorohydrin resins having azetidinium unctionality. , vol. TAPP! Journal Apr. 19, 2021.*

International Search Report and Written Opinion, in connection with International Application No. PCT/FI2021/050156, dated Apr. 29, 2021.

Fisher Stephen A: Structure and wet strength activity of polyamidoamine epichlorohydrin resins having azetidinium functionality. vol. TAPPI Journal Nov. 1996. Retrieved on Apr. 19, 2021 from the internet: URL:https://imisrise.tappi.org/TAPPI/Products/96/NOV/96NOV179.aspx ; table 1.

Search report and English translation thereof from the State Intellectual Property Office of the People's Republic of China for corresponding application 2021800128412, mailed on Jul. 27, 2023. 4p.

* cited by examiner

*Primary Examiner* — Dennis R Cordray
*Assistant Examiner* — Matthew M Eslami
(74) *Attorney, Agent, or Firm* — Meunier Carlin & Curfman LLC

(57) ABSTRACT

The invention relates to a composition and method for manufacture of paper, board, tissue or the like. The composition comprises an amphoteric polymer component, which has a weight average molecular weight of at least 600 000 g/mol, preferably at least 1 000 000 g/mol, more preferably at least 2 000 000 g/mol, and at least one synthetic cationic polymer component, which is a copolymer of a polyamidoamine and has a weight average molecular weight ≤550 000 g/mol, preferably ≤500 000 g/mol, more preferably ≤400 000 g/mol and dispersity index more than 15, preferably more than 20, more preferably more than 25.

13 Claims, No Drawings

COMPOSITION AND METHOD FOR MANUFACTURE OF PAPER, BOARD OR THE LIKE

FIELD OF THE INVENTION

The present invention relates to a composition and method for manufacture of paper, board, tissue or the like according to the preambles of the enclosed independent claims.

BACKGROUND OF THE INVENTION

In manufacture of paper, board, tissue and the like, various chemical additives are used with the intention to improve the properties, such as wet strength, of the final produced product, or to improve the efficiency of the papermaking process by enhancing e.g. retention or drainage. Many of these chemical additives are synthetic cationic polymers that are added to the fibre stock, where they interact with the fibres and/or with other stock constituents. Examples of such synthetic polymers are cationic copolymers of polyamidoamine and epichlorohydrin (PAE) that are often used e.g. to improve the wet strength properties of the produced paper, board or tissue.

The additives used in manufacture of paper, board, tissue and the like should be both effective and easy to handle. Quite often, the high molecular weight of the synthetic polymer is associated with high or improved efficiency. The problem is that even though polymerisation methods exist for providing high molecular weight synthetic polymers, the obtained polymer products in solution form are challenging to handle and use, for example due to their high viscosities, limited solid contents and/or short shelf-life. These problems limit the practical use of the synthetic polymers in solution form with high molecular weight. Manufacture of structured synthetic polymers, such as PAE and the like, which typically involves use of multifunctional reagents or crosslinkers, may be even more problematic. Structured, i.e. branched and/or crosslinked, polymers have often broad molecular weight distributions, i.e. high dispersity indices. In practice this may lead to situations where the polymerisation reaction has proceeded to a maximum viscosity where the obtained polymer is still handleable, but the obtained polymer comprises only a small percentage of polymer molecules having a high molecular weight, while majority of the polymer molecules have a much lower molecular weight. The small percentage of the high molecular weight polymer molecules raise the viscosity of the obtained polymer product, but the large amount of the low molecular weight polymer molecules in the polymer product lead to the insufficient or even complete lack of desired operational efficiency in the intended use in paper or board manufacture, as the low molecular weight polymer molecules typically has decreased performance compared to high molecular weight polymer molecules.

There have been several attempts to solve the above-mentioned problems, especially relating to the reduced efficiency of the synthetic polymer compositions having high dispersity indices. For examples, use of various filtration techniques has been proposed for removal of the polymer fractions with small molecular weight from the obtained polymer products. However, these approaches require use of complex processes and additional equipment, rendering the manufacture of the synthetic polymers complicated and expensive. Furthermore, the separated low molecular weight fraction is usually disregarded, which reduces the overall efficiency of the manufacturing process.

Especially, there is a desire to improve the effectivity of common synthetic cationic polymers, such as PAE, having a broad molecular weight distribution without negatively influencing their usability or requiring additional process steps in the polymer manufacturing. It would be beneficial to improve the wet strength effect obtainable from the existing synthetic cationic polymers, such as PAE.

SUMMARY OF THE INVENTION

An object of this invention is to minimise or even eliminate the disadvantages existing in the prior art.

An object of the present invention is also to provide a composition, which comprises a cationic polymer component with high dispersity index, but which still provides improved efficiency, especially wet strength, when used in the manufacture of paper, board or tissue.

Yet another object of the present invention is to provide a composition, which is easy to handle and apply, for example for improving the wet strength of the produced fibrous web, in the manufacture of paper, board or tissue.

These objects are attained with a composition and method having the characteristics presented below in the characterising parts of the independent claims. Some preferable embodiments of the invention are described in the dependent claims.

The features recited in the dependent claims and the embodiments disclosed in the description are mutually freely combinable unless otherwise explicitly stated.

The exemplary embodiments presented in this text and their advantages relate by applicable parts to all aspects of the invention, both to the composition and the method, even though this is not always separately mentioned.

A typical composition according to the present invention for manufacture of paper, board, tissue or the like, comprises

- an amphoteric polymer component, which has a weight average molecular weight of at least 600 000 g/mol, preferably at least 1 000 000 g/mol, more preferably at least 2 000 000 g/mol, and
- at least one synthetic cationic polymer component, which is a copolymer of a polyamidoamine having a weight average molecular weight 550 000 g/mol, preferably 500 000 g/mol, more preferably 400 000 g/mol and a dispersity index more than 15, preferably more than 20, more preferably more than 25.

A typical method according to the present invention for making paper, board or the like, comprises steps of

- obtaining a fibre stock,
- adding a composition according to the present invention to the fibre stock,
- forming a fibrous web and drying it.

DETAILED DESCRIPTION OF THE INVENTION

Now it has been surprisingly found that the presence of an amphoteric polymer component in the composition unexpectedly improves the desired performance in the manufacture of paper, board, tissue or the like, such as wet strength, retention and/or drainage effect, obtainable with a synthetic cationic polymer component with relatively high dispersity index. It is assumed, without wishing to be bound by a theory, that the anionic sites of the amphoteric polymer component may form ionic bonds with the oppositely charged sites of the cationic polymer component and/or self-looping of the amphoteric polymer component may be possible. For example, there can be some kind of formation of ionic complexes and/or ionic constituents in the composition, where the cationic polymer component is trapped within the three-dimensional structures formed by the self-looping of the amphoteric polymer component. The assumed result is an increase in molecular weight and molecular size of the formed complexes and/or constituents in the composition, which enhances the performance. Furthermore, the retention to the fibre web of the composition according to the present invention, comprising these complexes or constituents formed by the amphoteric polymer component and the synthetic cationic polymer component, is good. This means that the retention of the synthetic cationic polymer component as such increases when it is added as a part of the composition. Consequently, the low molecular weight components are effectively retained to the web.

It is assumed that the composition according to the present invention is especially beneficial for collecting and/or trapping the low molecular weight fractions of the synthetic cationic polymer component and improving their retention to the fibrous web. Conventionally, the low molecular weight fractions provide small or negligible effect to the desired performance, when the synthetic cationic polymer component is used in manufacture of paper, board, tissue or the like. In a conventional use, this may necessitate an increased dosage of the synthetic cationic polymer component in order to reach the desired performance level, which may then lead to increased accumulation of unretained low molecular weight fraction of the synthetic cationic polymer component to the circulating waters of the paper, board or tissue mill. This may increase COD/BOD load and/or the risk for deposits on fibrous web and/or equipment in the conventional process. As the composition of the present invention is able to increase the retention of the low molecular weight fraction of the synthetic cationic polymer, it also enables the reduction of the amount of the synthetic cationic polymer component required while still providing desired performance level. Alternatively, the amount of the synthetic cation polymer component may be increased for improved performance, while reducing or avoiding substantial polymer accumulation and/or increase in COD/BOD in circulating waters, and/or deposit formation on process surfaces. The amphoteric polymer component of the composition may function as a vehicle bridging the low molecular weight fraction of the synthetic cationic polymer component into aggregates having a higher molecular weight and size.

The synthetic cationic polymer component of the composition has a weight average molecular weight ≤550 000 g/mol, preferably ≤500 000 g/mol, more preferably ≤400 000 g/mol. According to one embodiment the synthetic cationic polymer component may have a weight average molecular weight in the range of 50 000-550 000, preferably 100 000-500 000, more preferably 150 000-400 000. The weight average molecular weight of the cationic polymer component may thus be kept relatively low.

The synthetic cationic polymer component in the composition may have a dispersity index more than 15, preferably more than 20, more preferably more than 25. In the present context the term "dispersity index" describes the heterogeneity of the molecular weight of the polymer component. The dispersity index (PDI) is calculated by dividing the mass-average molecular weight $M_W$ with the number-average molecular weight $M_n$, i.e. by using a formula $PDI=M_W/M_n$. According to one embodiment of the invention the synthetic cationic polymer component may have a dispersity index more than 30, preferably more than 35, more preferably more than 40, even more preferably more than 45. The synthetic cationic polymer component may have a dispersity index less than 200, preferably less than 150. The higher the dispersity index, the more the synthetic cationic polymer component is assumed to contain polymer molecules of low molecular weight, thereby benefiting more from being present in the composition together with the amphoteric polymer component.

According to one embodiment of the invention the composition comprises a synthetic cationic polymer component, which is selected from copolymers of polyamidoamine and an organic multifunctional reagent, preferably epihalohydrin, more preferably epichlorohydrin. Typically, the polyamidoamine may comprise a reaction product of a polycarboxylic acid and a polyamine, optionally diethylenetriamine. According to one preferable embodiment the polycarboxylic acid may be adipic acid. The used polyamidoamine may have a weight average molecular weight <15 000 g/mol, preferably <12 000 g/mol, more preferably <10 000 g/mol, sometimes even <8000 g/mol, for example 5000-6000 g/mol, and/or a dispersity index>1, preferably >1.5, more preferably >2. Typically, the polyamidoamine has a dispersity index <10. A typical polyamidoamine may have a dispersity index of about 2-3.5, preferably 2.3-3.2.

In the present context the organic multifunctional reagent denotes an organic reagent that has at least two or more functional groups capable of reacting with the polyamidoamine, optionally diethylenetriamine, forming at least two covalent bonds. Thus, intra- and/or intermolecular cross-links may be generated. According to one embodiment the multifunctional reagent is a bifunctional reagent that has two functional groups capable of reacting with the polyamidoamine, optionally diethylenetriamine. Preferably the multifunctional reagent is or comprises epihalohydrin, more preferably epichlorohydrin. Preferably the synthetic cationic polymer component of the composition is a copolymer of polyamidoamine which is reacted with epichlorohydrin, i.e. copolymer of polyamidoamine and epichlorohydrin.

The synthetic cationic polymer component of the composition may have a charge density of at least 1 meq/g, preferably at least 1.5 meq/g, more preferably at least 2 meq/g, measured at pH 4.0 by using a Particle Charge Detector, Mütek PCD03. The charge density may be in the range of 1-4 meq/g, preferably 1.5-3.5 meq/g, more preferably 1.7-3.2 meq/g or 2-3.2 meq/g, measured at pH 4.0. The charge density values are given for the cationic polymer component calculated as dry. If the synthetic cationic polymer component of the composition is a copolymer of polyamidoamine and epihalohydrin, preferably copolymer of polyamidoamine and epichlorohydrin, its charge density may be in the range of 2.5-3.5 meq/g, measured at pH 4.

The composition according to the present invention comprises also an amphoteric polymer component. In the present context, the term "amphoteric" denotes that the polymer component has both anionic and cationic functional groups present in its structure at pH 7. Typically, the anionic and cationic functional groups are pendant groups attached to the backbone of the amphoteric polymer component. The amphoteric polymer component may have a total ionicity of at least 3 mol-%, preferably at least 5 mol-%, more preferably at least 7 mol-%, calculated from the total of anionic, cationic and non-ionic monomers. Sometimes the amphoteric polymer component may even have a total ionicity of at least 10 mol-%. According to one embodiment the total ionicity may be at most 50 mol-%, preferably at most 40 mol-%, more preferably at most 35 mol-%, even more preferably at most 30 mol-%, calculated from the total of anionic, cationic and non-ionic monomers. The total ionicity denotes the amount of all structural units originating from charged monomers, both cationic and anionic, in the amphoteric polymer. The amphoteric polymer component may have a total ionicity in the range of 3-50 mol-%, preferably 5-40 mol-%, more preferably 7-30, calculated from the total of anionic, cationic and non-ionic monomers. According to one preferable embodiment the amphoteric polymer component may have a total ionicity in the range of 5-20 mol-%, preferably 7-15 mol-%, calculated from the total of anionic, cationic and non-ionic monomers.

The amphoteric polymer component may be net anionic at pH 7, which means that the amphoteric polymer component comprises more anionic functional groups than cationic functional groups at pH 7. According to another embodiment, the amphoteric polymer component may be net cationic at pH 7, which means that the amphoteric polymer component comprises more cationic functional groups than anionic functional groups at pH 7. It is also possible that the amphoteric polymer component is net neutral at pH 7, which means that the number of anionic and cationic groups in the amphoteric polymer component is approximately the same at pH 7. It is assumed, without wishing to be bound by any theory, that if the amphoteric polymer component is net anionic, it improves the control of the zeta potential of the fibre stock when the composition is used in paper, board or tissue manufacture. Simultaneously this allows higher dosage of the synthetic cationic polymer component, with improved performance results, such as wet strength. On the other hand, if the amphoteric polymer component of the composition is net cationic, it is assumed to show an increased interaction with the anionic surfaces of the fibers and other stock constituents carrying anionically charged sites.

According to one preferable embodiment the amphoteric polymer component may be net cationic at pH 7.

The amphoteric polymer component may have an anionicity of at least 0.5 mol-%, preferably at least 1 mol-%. According to one embodiment the anionicity may be at most 30 mol-%, preferably at most 20 mol-%. For example, the amphoteric polymer component may have an anionicity in the range of 0.5-30 mol-%, preferably 1-20 mol-% or 1-17.5 mol-%, calculated from the total of anionic, cationic and non-ionic monomers. According to one embodiment the amphoteric polymer component may have an anionicity in the range of 0.5-5 mol-%, preferably 1-5 mol-%, calculated from the total of anionic, cationic and non-ionic monomers. The anionicity denotes here the amount of anionic structural monomer units present in the amphoteric polymer component of the composition.

The amphoteric polymer component may have a cationicity of at least 3 mol-%, preferably at least 5 mol-%. According to one embodiment the cationicity may be at most 35 mol-%, preferably at most 25 mol-%. For example, the amphoteric polymer component may have a cationicity in the range of 3-35 mol-%, preferably 5-25 mol-%, calculated from the total of anionic, cationic and non-ionic monomers. According to one embodiment the amphoteric polymer component may have a cationicity in the range of 5-15 mol-%, preferably 5-10 mol-%, calculated from the total of anionic, cationic and non-ionic monomers. The cationicity denotes here the amount of cationic structural monomer units present in the amphoteric polymer component of the composition.

According to one embodiment the amphoteric polymer component, suitable for use in the composition, may be obtained by polymerisation of at least one non-ionic monomer, at least one cationic monomer and at least one anionic monomer. The non-ionic monomer may be selected from methacrylamide, acrylamide and any combination thereof. Preferably the non-ionic monomer is acrylamide.

The amphoteric polymer component may be obtained, i.e. polymerised, by using any suitable polymerisation technique, such as solution polymerisation, emulsion polymerisation or gel polymerisation with drying.

The at least one cationic monomer for polymerisation of the amphoteric polymer component may be selected from a group comprising 2-(dimethylamino)ethyl acrylate (ADAM), [2-(acryloyloxy)ethyl]trimethylammonium chloride (ADAM-Cl), 2-(dimethylamino)ethyl acrylate benzylchloride, 2-(dimethylamino)ethyl acrylate dimethylsulphate, 2-dimethylaminoethyl methacrylate (MADAM), [2-(methacryloyloxy)ethyl]trimethylammonium chloride (MADAM-Cl), 2-dimethylaminoethyl methacrylate dimethylsulphate, [3-(acryloylamino)propyl]trimethylammonium chloride (APTAC), [3-(methacryloylamino)propyl]trimethylammonium chloride (MAPTAC), and diallyldimethylammonium chloride (DADMAC). Preferably the cationic monomer is [2-(acryloyloxy)ethyl]trimethylammonium chloride (ADAM-Cl) or diallyldimethylammonium chloride (DADMAC).

The at least one anionic monomer for polymerisation of the amphoteric polymer component may be selected from a group comprising acrylic acid, methacrylic acid, maleic acid, fumaric acid, itaconic acid, aconitic acid, mesaconic acid, citraconic acid, crotonic acid, isocrotonic acid, angelic acid, tiglic acid, vinylsulphonic acid, allylsulphonic acid, methallylsulphonic acid, styrenesulphonic acid, 2-acrylamido phenylpropanesulfonic acid, 2-acrylamido-2-methylpropanesulfonic acid, and their salts. Preferably the anionic monomer is selected from group comprising acrylic acid, methacrylic acid and itaconic acid.

According to some embodiments of the invention the amphoteric polymer component of the composition may be obtained by polymerisation of one or more of non-ionic, cationic or/and anionic monomers, and subsequently modifying at least part of the units originating from said monomer(s). By way of an example, cationic units may be generated to the amphoteric polymer component by modification of an existing unit originating from a non-ionic and/or an anionic monomer. Examples of such modifications include post-polymerization hydrolysis of a non-ionic group, such as formamide group. In an analogous manner and by way of an example, anionic units may be generated to the amphoteric polymer component by modification of an existing unit originating from a cationic and/or a non-ionic monomer. Examples of such modifications include post-polymerization hydrolysis of a cationic group, such as cationic ester group, and/or hydrolysis of a non-ionic group, such as amide group, into an anionic group, whether intentionally, or unintentionally due to lability of the modified unit. Other examples of modification include derivatisation of e.g. a non-ionic group, such as amide group, into an anionic group. As understood by a skilled person, these well-known approaches may result in amphoteric polymer components having essentially the same characteristics as the amphoteric polymer components obtained by polymerisation of non-ionic, cationic and anionic monomers, and thus being equally usable in the composition of the present invention.

According to one embodiment the amphoteric polymer component of the composition may comprise vinylamine units. The amphoteric polymer component may be obtained, for example, by polymerisation of at least one N-vinylcarboxamide monomer, preferably N-vinylformamide, at least one anionic monomer, and optionally acrylonitrile and/or methacrylonitrile, wherein the polymerisation is followed by partial or complete hydrolysis of amide function originating from the N-vinylcarboxamide monomer into an amine function.

The amphoteric polymer component of the composition may have a weight average molecular weight of at least 600 000 g/mol, preferably at least 1 000 000 g/mol, more preferably at least 2 000 000 g/mol. The amphoteric polymer component may have a weight average molecular weight of up to 10 000 000 g/mol, preferably up to 8 500 000 g/mol, more preferably up to 7 000 000 g/mol. According to one embodiment the weight average molecular weight of the amphoteric polymer component is in the range of 600 000-9 000 000 g/mol, preferably 1 000 000-7 000 000 g/mol, more preferably 2 000 000-6 000 000 g/mol. The average molecular weight of the amphoteric polymer component is relative to the length of the polymer component backbone. It has been observed that preferably the amphoteric polymer component of the composition has relatively high weight average molecular weight, which improves its interaction with the synthetic cationic polymer component. It is speculatively assumed that as the length of the amphoteric polymer component increases, its ability to "trap" the synthetic cationic polymer component in the composition and consequently to the fibre web to be formed improves. However, too high average molecular weight of the amphoteric polymer component may lead to increased flocculation of the fibre stock, which may be desired or at least not disturbing in certain applications, such as for retention and/or drainage, while unwanted and even detrimental in some other applications, such as for paper strength.

In the composition according to the present invention the weight average molecular weight of the amphoteric polymer component is higher than the weight average molecular weight of the cationic polymer component.

According to one embodiment of the invention the amphoteric polymer component of the composition may have a dispersity index of 1-30, preferably 1-25, more preferably 1-20. The dispersity index is calculated as described earlier in this text.

The composition may comprise 0.5-15 weight-%, preferably 1-10 weight-%, more preferably 1-7 weight-%, even more preferably 1-5 weight-%, of amphoteric polymer component, calculated from the total dry weight of the amphoteric polymer component and the synthetic cationic polymer component in the composition. It has been observed that even small amounts of the amphoteric polymer component in the composition may provide significant increase in retention of the synthetic cationic polymer component and improvement in wet strength effects obtained.

The composition may comprise 85-99.5 weight-%, preferably 90-99 weight-%, more preferably 93-99 weight-%, even more preferably 95-99 weight-%, of the synthetic cationic polymer component, calculated from the total dry weight of the amphoteric polymer component and the synthetic cationic polymer component in the composition.

According to one embodiment of the invention the amphoteric polymer component and the synthetic cationic polymer component of the composition are added to the fibre stock as a pre-mixed composition, i.e. the composition is an aqueous mixture of the amphoteric polymer component and the synthetic cationic polymer component. The amphoteric polymer component and the synthetic cationic polymer component may be mixed with each other before the addition of the composition as an aqueous solution to the fibre stock, i.e. before the addition of composition as a single solution. The mixing may be performed in any suitable way of combining the amphoteric polymer component and the synthetic cationic polymer component. For example, it is possible to mix the amphoteric polymer component and the synthetic cationic polymer component as aqueous solutions, or the amphoteric polymer component in dry form may be dissolved to an aqueous solution of the synthetic cationic polymer component. When the composition comprises the amphoteric polymer component and the synthetic cationic polymer component as a pre-mixed composition, the composition may have a pH value in the range of 2.0-3.5, preferably 2.5-3.5, and/or a dry content of 10-50 weight-%, calculated from the total weight of the composition.

According to another embodiment of the invention the composition may be formed at the time of addition, i.e. the amphoteric polymer component and the synthetic cationic polymer component may be added to the fibre stock simultaneously but separately. For example, the amphoteric polymer component and the synthetic cationic polymer component may be introduced to the fibre stock through a single inlet to which their separate aqueous solutions are fed. For example, the amphoteric polymer component and the synthetic cationic polymer component may be fed to a pipeline leading to the single inlet, whereby the the amphoteric polymer component and the synthetic cationic polymer component are at least partially mixed already in the pipeline before the inlet to form the composition according to the invention. Alternatively, the amphoteric polymer component and the synthetic cationic polymer component may be fed to two pipelines leading to the single inlet, whereby they are mixed together to form the composition at the moment they are introduced to the fibre stock. These embodiments are advantageous as the time for interaction between the components may be easily adjusted. The weight ratio between the the amphoteric polymer component and the synthetic cationic polymer component in the composition can be also flexibly adjusted, for example on basis of any changes in fibre stock properties.

The composition may be used in manufacture of paper, board, tissue or the like, for example, for retention and/or fixation of dissolved, colloidal and/or solid suspended materials, including dyes etc, or for improving paper/board/tissue strength characteristics, especially wet strength. According to one preferable embodiment the composition according to the invention is used for improving wet strength properties of a cellulosic fibrous web, such as paper, board, tissue or the like. The composition may also be used as an adhesive, such as a creping adhesive in a tissue manufacturing process.

EXPERIMENTAL

Measurement Methods Used in the Examples

Following methods were used in the examples for analysing the characteristics of aqueous polymer components and/or polysaccharide solutions and the produced handsheets:

- Dry solids content was analysed by using Mettler Toledo HR73, at 150° C.
- Viscosity was analysed by using Brookfield LV DV1, equipped with small sample adapter, at 25° C., using spindle S18. The highest feasible rotation speed for the spindle was used.
- pH of the solution was analysed by using a calibrated pH-meter.

Molecular sizes of polymer components were analysed by gel permeation chromatography, GPC, system equipped with integrated autosampler, degasser, column oven and refractive index detector. Eluent was a buffer solution containing 0.3125 M acetic acid and 0.3125 M sodium acetate, flow rate 0.5 ml/min at 35° C. The column set consisted of a precolumn and two columns, a TSKgel PWXL guard column and two TSKgel GMPWXL columns, by Tosoh Biosciences. A refractive index detector was used for detection.

Molecular weights were determined by using conventional column calibration with polyethyleneoxide/polyethyleneglycol narrow molecular weight distribution standards by Polymer Standards Service GmbH, Germany. The injection volume was 50 μl with a sample concentration of about 0.1-4 mg/ml, depending on the sample. Ethylene glycol 1 mg/ml was used as a flow marker.

Basis weight of the handsheets was determined by Mettler Toledo scale by ISO 536.

Tensile strength and wet tensile strength of the handsheets were determined by Lorentzen & Wettre device by ISO 1924-3

Example 1: Composition Comprising a Copolymer of Polyamidoamine-Epichlorohydrin (PAE, Wet Strength Polymer) and an Amphoteric Polymer Component A series of compositions comprising a copolymer of polyamidoamine and epichlorohydrin as a synthetic cationic component and an amphoteric polyacrylamide as an amphoteric polymer component.

The used copolymer of polyamidoamine and epichlorohydrin was a commercial PAE, with dry content of 25.5 weight-%, viscosity of 147 cP at 25° C., pH 3.01 at 23° C., a weight average molecular weight Mw of 250 000 g/mol, a number average molecular weight Mn of 2750 g/mol, and a polydispersity index 91.

The used amphoteric polymer component was a copolymer of acrylamide (91 mol-%), acryloyloxyethyltrimethylammonium chloride (7 mol-%) and acrylic acid (2 mol-%) with a dry content of 92 weight-% and a weight average molecular weight Mw of 5 000 000 g/mol, Mn 350 000 g/mol, and a polydispersity index 14.

The amphoteric polymer component was dissolved in water by mixing 16.3 g amphoteric polymer component in 1000 g de-ionized water and mixing by 500 rpm for 60 min. Concentration of the amphoteric polymer component in solution was 1.5 weight-%.

PAE solution (25.5 weight-%) and de-ionized water were added in a beaker. Amphoteric polymer component solution (1.5 weight-%) was added to PAE solution under mixing by 500 rpm. Mixing was continued for 5 min and then pH was adjusted with sulfuric acid (50 weight-%). The amounts of components and characteristics of the prepared compositions are given in Table 1.

TABLE 1

Characteristics of the prepared compositions

| | Composition A | Composition B | Composition C |
|---|---|---|---|
| PAE (25.5%), g | 105.0 | 104.5 | 103.8 |
| Amphoteric polymer component (1.5%), g | 27.2 | 36.3 | 45.3 |

TABLE 1-continued

Characteristics of the prepared compositions

| | Composition A | Composition B | Composition C |
|---|---|---|---|
| DI-water, g | 17.8 | 9.2 | 0.9 |
| Sulphuric acid (50%), g | 0.47 | 0.46 | 0.38 |
| Total, g | 150.5 | 150.4 | 150.4 |
| PAE proportion, weight-% | 98.5 | 98.0 | 97.5 |
| Amphoteric polymer component proportion, weight-% | 1.5 | 2.0 | 2.5 |
| Dry content, weight-% | 18.1 | 18.1 | 18.1 |
| pH | 2.91 | 2.90 | 2.91 |
| Viscosity at 25° C., cP | 115 | 138 | 171 |

Example 2: Impact of Amphoteric Polymer Component on Molecular Size of the Composition A series of compositions were made by using the same copolymer of polyamidoamino and epichlorohydrin and amphoteric polymer component as in example 1. The compositions had a dry content of 15 weight-% and pH was adjusted to 4.5 with diluted sodium hydroxide solution. Molecular weights were analysed by GPC. Theoretical weighted averages were calculated, i.e. the weighted average without any interaction between the components of the composition. The results are shown in Table 2.

TABLE 2

Results of Example 2.

| | PAE (reference) | Composition E | Composition F | Composition G |
|---|---|---|---|---|
| PAE (25.5%), g | 88.2 | 88.0 | 87 | 86 |
| Amphoteric polymer component (1.5%), g | 00 | 22.8 | 30.2 | 37.5 |
| DI-water, g | 61.8 | 41.2 | 33.8 | 26.5 |
| Total solution, g | 150.0 | 152.0 | 151.0 | 150.0 |
| Dry content, weight-% | 15.0 | 15.0 | 15.0 | 15.0 |
| Proportion of amphoteric polymer of dry material, weight-% | 0.0 | 1.5 | 2.0 | 2.5 |
| Weight average molecular weight Mw, g/mol | 249 700 | 339 650 | 397 150 | 413 000 |
| Theoretical weighted average, g/mol | 249 700 | 320 955 | 344 706 | 368 458 |

It can be seen from the results shown in Table 2 that the determined molecular weight average Mw is higher than the molecular weight based on the theoretical weighted average. This indicates that a polyion-complex formation takes place and that the amphoteric polymer component "increases" the molecular size of the PAE molecules.

Example 3: Application Example

Example 3 simulates preparation of laminate base kraft paper. Sheets were prepared in laboratory sheet mould. Test fibre stock was 70 weight-% of brown softwood virgin kraft and 15 weight-% of old corrugated container, OCC, and 15 weight-% of broke. Stock was taken directly from a mill and diluted with clear filtrate. Consistency of the stock was adjusted to 5.4 g/liter. Conductivity was 1.2 mS/cm.

Retention agent, cationic polyacrylamide (FennoPol K 3400P, Kemira Oyj), 80 g/t, and silica microparticle (Fennosil 5000, Kemira Oyj), dosage 3 kg/t as received, 0.39 kg dry basis/t, were used in all test points. The addition scheme is as follows: PAE (same as in Example 1) is added at 0 s, retention polymer is added after 40 s, silica microparticle is added after 50 s. After 60 s the furnish is added to the sheet mould and drained. The sheet was dried in a sheet dryer between blotting sheets at 120° C., 5 min/side. Sheet were conditioned before analyses. Wet tensile strength was determined after moistening on 10 min. Results are shown in Table 3.

It is seen from the results in Table 3 that the wet/dry-ratio is improved when proportion of amphoteric polymer component in the composition increases. It provides evidence that the amphoteric polymer captures PAE by polyion-complexation, the molecular size of the PAE "increases" and the strength response from the PAE is improved.

TABLE 3

Results of Example 3.

| Amphoteric polymer component, kg dry/t | PAE — | Comp. A 1.5 | Comp. B 2 | Comp. C 2.5 | Basis weight (g/m$^2$) | Tensile strength, wet(* (N/mm) | Tensile strength, dry(** (N/mm) | Wet/dry-ratio (%) |
|---|---|---|---|---|---|---|---|---|
| Test 1 (0-test) | — | — | — | — | 118.3 | 0.113 | 2.24 | 5.0 |
| Test 2 (Ref.) | 0.5 | — | — | — | 119.9 | 0.168 | 2.;44 | 6.9 |
| Test 3 (Ref.) | 1 | — | — | — | 119.9 | 0.220 | 2.40 | 9.2 |
| Test 4 (Ref.) | 2 | — | — | — | 121.4 | 0.319 | 2.66 | 12.0 |
| Test 5 | — | 0.5 | — | — | 121.6 | 0.182 | 2.46 | 7.4 |
| Test 6 | — | 1 | — | — | 121.6 | 0.234 | 2.34 | 10.0 |
| Test 7 | — | 2 | — | — | 121.9 | 0.332 | 2.56 | 13.0 |
| Test 8 | — | — | 0.5 | — | 120.9 | 0.200 | 2.54 | 7.9 |
| Test 9 | — | — | 1 | — | 121.1 | 0.254 | 2.64 | 9.6 |
| Test 10 | — | — | 2 | — | 121.7 | 0.344 | 2.66 | 12.9 |
| Test 11 | — | — | — | 0.5 | 121.1 | 0.211 | 2.60 | 8.1 |
| Test 12 | — | — | — | 1 | 120.4 | 0.255 | 2.55 | 10.0 |
| Test 13 | — | — | — | 2 | 121.3 | 0.365 | 2.56 | 14.3 |

(*Tensile strength, measured from wet web: after 10 min wetting in a water bath at 23° C., free/excess water is removed by putting wet stripes between two plotter sheets and gently removing excess water without pressing, absorbed water is not to be removed.
(**Tensile strength, measured from dried web Even if the invention was described with reference to what at present seems to be the most practical and preferred embodiments, it is appreciated that the invention shall not be limited to the embodiments described above, but the invention is intended to cover also different modifications and equivalent technical solutions within the scope of the enclosed claims.

The invention claimed is:

1. A pre-mixed composition for manufacture of paper, board, or tissue, wherein the pre-mixed composition comprises:

0.5-15 weight % of an amphoteric polymer component, which is net cationic at pH 7 and has a weight average molecular weight of at least 600 000 g/mol, and 85-99.5 weight % of at least one synthetic cationic polymer component, which is a copolymer of a polyamidoamine having a weight average molecular weight≤550 000 g/mol and a dispersity index more than 15 calculated from the total dry weight of the amphoteric polymer component and the synthetic cationic polymer component, wherein the amphoteric polymer component is obtained by polymerisation of at least one non-ionic monomer, at least one cationic monomer, and at least one anionic monomer, wherein the at least one non-ionic monomer is (meth)acrylamide.

2. The composition according to claim 1, wherein the synthetic cationic polymer component has the dispersity index more than 30.

3. The composition according to claim 1, wherein the synthetic cationic polymer component is selected from copolymers of polyamidoamine and an organic multifunctional reagent of epihalohydrin.

4. The composition according to claim 1, wherein the synthetic cationic polymer component has a weight average molecular weight in the range of 50 000-550 000.

5. The composition according to claim 1, wherein the synthetic cationic polymer component has a charge density of at least 1 meq/g, measured at pH 4.0.

6. The composition according to claim 1, wherein the amphoteric polymer component has a total ionicity of at least 3 mol.

7. The composition according to claim 1, wherein the amphoteric polymer component has an anionicity of at least 0.5 mol.

8. The composition according to claim 1, wherein the amphoteric polymer component has a weight average molecular weight in the range of 600 000-9 000 000 g/mol.

9. The composition according to claim 1, wherein the amphoteric polymer component has a dispersity index of 1-30.

10. The composition according to claim 1, wherein the composition comprises 1-10 weight % of the amphoteric polymer component, calculated from the total dry weight of the amphoteric polymer component and the synthetic cationic polymer component.

11. The composition according to claim 1, wherein the composition comprises 90-99 weight % of the synthetic cationic polymer component, calculated from the total dry weight of the amphoteric polymer component and the synthetic cationic polymer component.

12. The composition according to claim 1, wherein the composition has a pH value in the range of 2.0-3.5, and/or a dry content of 10-50 weight-%, calculated from the total weight of composition.

13. A method for making paper, board or tissue, comprising steps-obtaining a fibre stock, adding a composition according to claim 1 to the fibre stock, forming a fibrous web, and drying the fibrous web.

* * * * *